US005406730A

United States Patent [19]

Sayre

[11] Patent Number: 5,406,730

[45] Date of Patent: Apr. 18, 1995

[54] ELECTRONIC AMMUNITION COUNTER

[76] Inventor: Cotter W. Sayre, 22026 Wyandotte St., Canoga Park, Calif. 91303

[21] Appl. No.: 282,815

[22] Filed: Jul. 29, 1994

[51] Int. Cl.[6] ..... F41A 9/62

[52] U.S. Cl. ..... 42/1.02; 42/84

[58] Field of Search ..... 42/1.02, 1.03, 70.01, 42/70.11, 84

[56] References Cited

U.S. PATENT DOCUMENTS

| | | | |
|---|---|---|---|
| 2,306,747 | 12/1942 | Ojalvo | 42/1.03 |
| 4,001,961 | 1/1977 | Johnson et al. | 42/1.03 |
| 5,005,307 | 4/1991 | Horne | 42/1.02 |
| 5,052,138 | 10/1991 | Crain | 42/1.02 |
| 5,142,805 | 9/1992 | Horne et al. | 42/1.02 |

*Primary Examiner*—David Brown

[57] ABSTRACT

A method and apparatus for counting the rounds expended from a firearm. When a non sound-suppressed firearm is discharged, two things occur: A strong sound wave is produced due to the quick expansion of the gases produced by the ignition of the powder in the case; and a rearward motion of the firearm occurs, usually referred to as recoil, due to the projectile moving in the forward direction, as Newton's law states. The integration of both recoil and sound transducers guarantees that in order for the device to increment or decrement both the recoil and the gunshot must occur in the same time frame, thus guaranteeing an accurate count with an easy to install and compact device comprised of an acoustic and dynamic switch, whose outputs are fed into the input of a NAND gate, with the output of the NAND gate fed into a digital counter, then fed into a decoder/driver for output into the output display. The device is able to be reset just before or just after reloading of the firearm by the push of a button.

1 Claim, 2 Drawing Sheets

ELECTRONIC AMMUNITION COUNTER

BACKGROUND OF INVENTION

BACKGROUND—FIELD OF INVENTION

This invention relates to a simple, low cost, and easy to manufacture device capable of allowing the user to visually inspect the amount of ammunition fired from a firearm by viewing an electronic numerical display.

BACKGROUND—DESCRIPTION OF PRIOR ART

Heretofore the only way to check the amount of ammunition remaining in a magazine-fed firearm was by mentally counting the rounds expended, or by ejecting the magazine and inspecting the rounds remaining by viewing the cartridges through either the inspection holes or the inspection slit or, in a revolver, by mentally counting the rounds expended, or by viewing the front of the cylinder for the amount of visibly remaining bullets seated in their cases, or by swinging out the cylinder to observe the primer dimples of the spent ammunition. While my device allows the user to simply look at one of the grip plates to instantly view, and in clear numeric format, the rounds remaining in a firearm without the time spent and inconvenience of removing a magazine or counting the rounds fired or viewing the front of a cylinder.

SUMMARY OF THE INVENTION

The invention relates to a new method of counting the shots fired from any firearm, thus allowing the user to quickly, simply, and reliably check the mount of remaining ammunition left in a firearm without the need to physically remove the magazine of a semi-automatic pistol or check the cylinder of a revolver to verify the amount of remaining ammunition.

Another object of this invention is to supply a device that is easily integrated into firearms during or after the manufacturing phase, or as an after-market device.

Still another object of this invention is to provide a device that needs no external sensors or switches attached to the firearm's mechanism to count shots fired, thus being simple to install and eliminating any chance of interfering with the firearm's reliability.

Still another object of this invention is to provide a device that is simple to manufacture, that uses common materials and techniques, and is thus low in cost to manufacture and purchase.

Still further objects and advantages of the invention will become apparent from consideration of the ensuing description and drawings.

DESCRIPTION OF THE PREFERRED EMBODIMENT

Referring to FIGS. 1, 2, 3, 4, 5, 6, an embodiment of the invention is shown.

Figure 1:
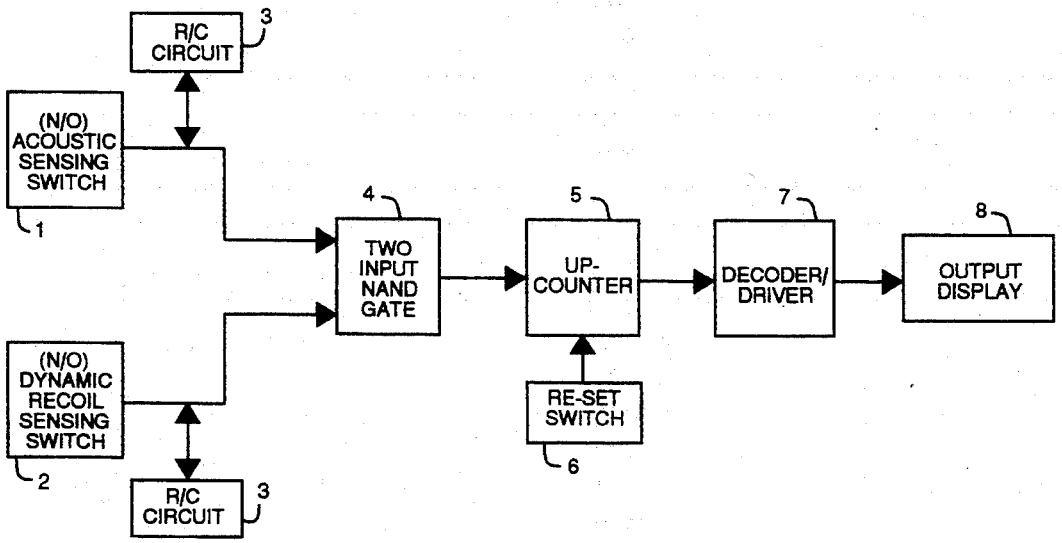
FIG. 1 is a view embodying the basic invention in block diagram form using an up-counter (5).
Figure 2:
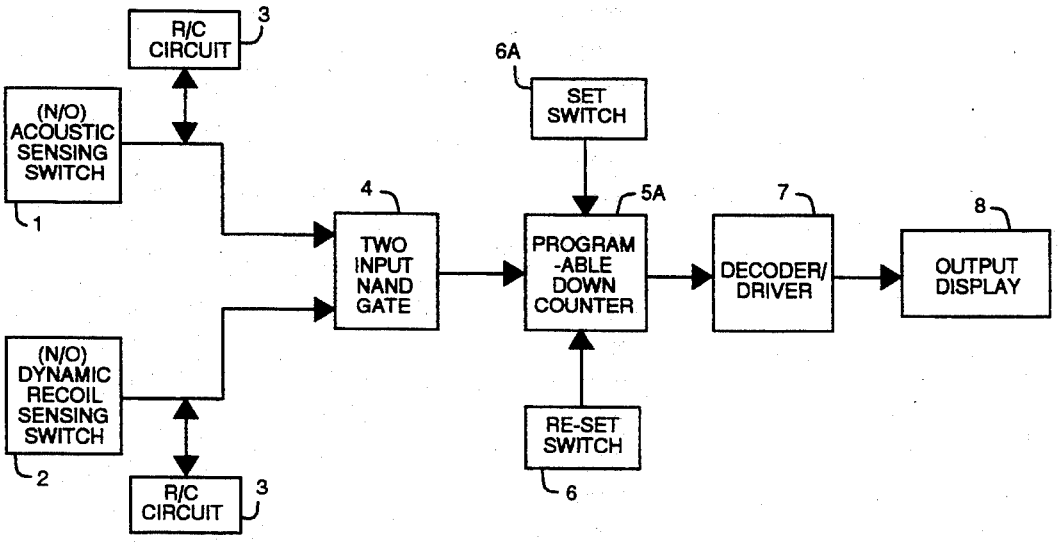
FIG. 2 is a view of an additional embodiment of the invention of FIG. 1 using a programmable down-counter (5A).

In this embodiment, referring to FIG. 1, said acoustic sensing switch (1) is attached to one input of a two input NAND gate (4), and said dynamic recoil sensing switch (2) is attached to the other input of said two input NAND gate (4). Placed between said acoustic sensing switch (1) and said two input NAND gate (4), as well as between said dynamic recoil sensing switch (2) and said two input NAND gate (4), are R/C circuits (3) to ground to maintain a high at the input of said two input NAND gate (4) for approximately 1/20th of a second, to overlap any time variances in said acoustic sensing switch's (1) and said dynamic recoil sensing switch's (2) momentary closed periods, as well as acting as a debounce for said acoustic sensing switch (1) and said dynamic recoil sensing switch (2), as well as supplying the input to a CMOS type of NAND gate, if used, a non-floating state when said acoustic sensing switch (1) and said dynamic recoil sensing switch (2) are in their normally open (N/O) positions. Attached to the output of the two input NAND gate (4) is an up-counter (5) with a re-set switch (6) to re-set said up-counter (5) to zero when new ammunition is loaded into the user's firearm. The output of said up-counter (5) is fed into a decoder/driver (7), which is then fed to the input of an output display (8), which then gives the user a numeric display of shots fired from his/her firearm. Referring to FIG. 2 is an additional embodiment of the invention of FIG. 1. Said acoustic sensing switch (1) is attached to one input of a two input NAND gate (4), and said dynamic recoil sensing switch (2) is attached to the other input of said two input NAND gate (4). Placed between said acoustic sensing switch (1) and said two input NAND gate (4), as well as between said dynamic recoil sensing switch (2) and said two input NAND gate (4) are said R/C circuits (3) to ground. Attached to the output of said two input NAND gate (4) is a programmable down-counter (5A) with a set switch (6A) to initially set said programmable down-counter (5A) to the numerical ammunition capacity of the user's firearm, and said re-set switch (6) to re-set said programmable down-counter (5A) to the initially fixed amount as set by said set switch (6A) after the user has discharged his ammunition capacity. The output of said programmable down-counter (5A) is fed into said decoder/driver (7), which is then fed to the input of said output display (8).

Figure 3:
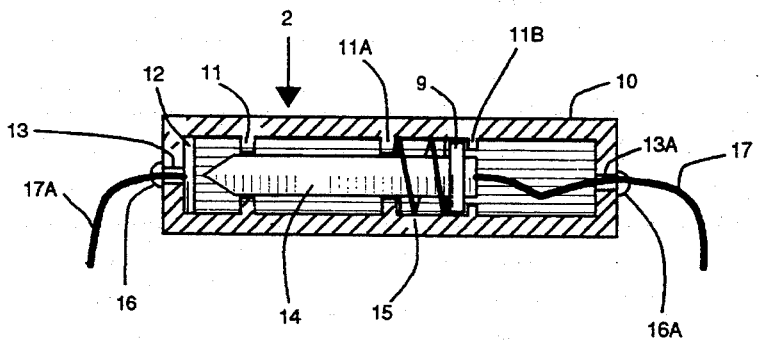
FIG. 3 is a view of one embodiment of a dynamic recoil sensing switch (2).

Referring to FIG. 3 is an example of one type of dynamic switch that may be used in the device, represented by said dynamic recoil sensing switch (2), comprised of a plastic case (10) enclosing a metal piston (14) with an integral piston ting (9), electrically connected to the rest of the circuit by a wire (17). An integral piston guide (11) and an integral piston guide/spring rest (11A) are a molded part of said plastic case (10) and allow said metal piston (14) to move freely within said plastic case (10), as well as said integral piston guide/spring rest (11A) acting as a return spring (15) annulus rest, with a piston rearward stop (11B) attached to said plastic case (10). A stator contact (12) is connected to a wire (17A), which connects said recoil sensing switch (2) to the rest of the circuit. Said wires (17, 17A) pass through foramens (13, 13A) which are sealed, and said wires (17, 17A) held in place, by seals (16, 16A) constructed of epoxy, solder, or any suitable substance.

Figure 4:
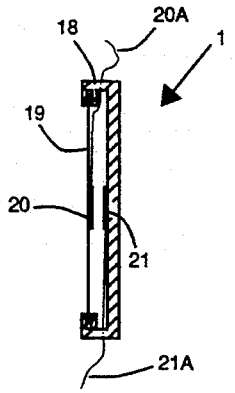
FIG. 4 is a view of one embodiment of an acoustic sensing switch (1) before and after noise impingement.

Referring to FIG. 4 is an example of one type of acoustic switch that may be used in the device, represented by said acoustic sensing switch (1), comprised of a case (18) with a metal stator contact (21) cemented into said case (18), with a free wire (21A) soldered to said metal stator contact (21), with said free wire (21A) connecting said acoustic sensing switch (1) to the rest of the circuit. Attached to said case (18), and facing said metal stator contact (21), is an acoustic membrane (19), constructed of rubber or any suitable material, with a thin metal contact (20) cemented to said acoustic membrane (19). Soldered to said thin metal contact (20) is a fine wire (20A), which connects said acoustic sensing switch (1) to the rest of the circuit. Said acoustic sensing switch (1) is shown with no noise impingement present.

Figure 5:
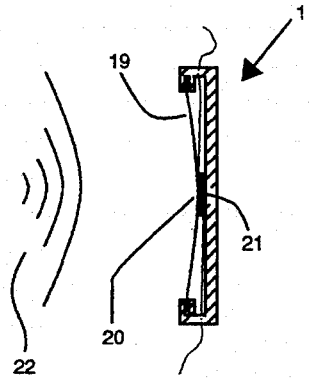
FIG. 5 is a view of said acoustic sensing switch (1) during noise impingement.

Referring to FIG. 5 is a view of said acoustic sensing switch (1) with noise impingement present. Said acoustic membrane (19) flexes inward when a sound front (22) strikes said acoustic membrane (19), driving said thin metal contact (20) into contact with said metal stator contact (21), completing the circuit.

Figure 6:
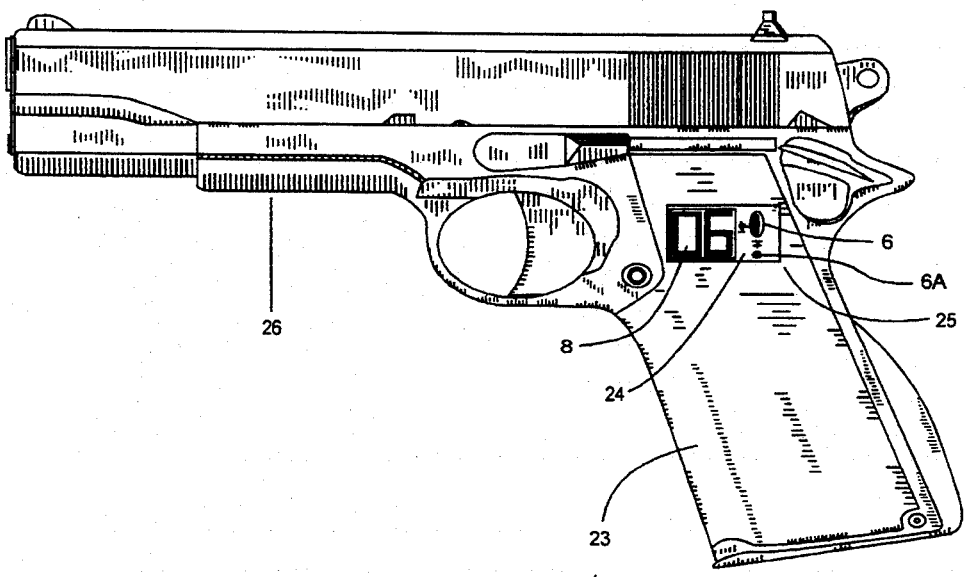
FIG. 6 is a view of the circuit of FIG. 2 encased and installed on a firearm (26).

Referring to FIG. 6 is a view of the circuit of FIG. 2 encased in a hard plastic case (24) with said re-set switch'(6) and said set switch (6A) recessed into said hard plastic case (24) to avoid accidental operation of said re-set switch (6) and said set switch (6A). Framed by said hard plastic case (24) is said output display (8), easily viewable to the user. This assembly (25) is shown as attached to after-market hand grips (23) by screws, tape, liquid adhesives, or any conventional means, with said after-market hand grips (23) installed by conventional means on a Colt Model 1911 pistol (26), but said assembly (25) can be similarly installed on any firearm.

OPERATION

Referring to the drawings in which like reference characters refer to like parts throughout the several views thereof, the manner of use of the invention is as follows:

In the circuit of FIG. 1, when a firearm is discharged a sound front resulting from the ignition of the powder in the cartridge exerts an acoustic pressure, which is picked up by a normally-open said acoustic sensing switch (1), which then closes momentarily. This sends a high input pulse to one of the inputs of said two input NAND gate (4), with said R/C circuit (3) maintaining this high input for approximately 1/20th of a second and also functioning as a switch de-bounce circuit. At approximately the same instant, the recoil of the firearm forces a normally-open said dynamic recoil sensing switch (2) to close momentarily, thus supplying a high pulse to the other input of said two input NAND gate (4), with said R/C circuit (3) maintaining this high input for approximately 1/20th of a second and also functioning as a switch de-bounce circuit. Said two input NAND gate's (4) previously high output state now falls to a low logic state. This falling edge triggers said up-counter (5) to increment by one. This information is then fed to said decoder/driver (7), which decodes and drives said output display (8), thus numerically displaying the amount of shots fired. After the user fires the remaining rounds, said up-counter (5) is re-set to zero by pressing said re-set switch (6), and the firearm is reloaded in a normal fashion.

In the circuit of FIG. 2, the user, after first installing the device, presses said set switch (6A), which increments said programmable down-counter (5A) by one, until said output display (8) displays the amount of ammunition resident in the firearm's magazine or cylinder. When the firearm is discharged a sound wave, resulting from the ignition of the powder in the cartridge, exerts an acoustic pressure, which is detected by a normally-open said acoustic sensing switch (1), which then closes momentarily. This sends a high input pulse to one of the inputs of said two input NAND gate (4), with said R/C circuit (3) maintaining this high for approximately 1/20th of a second and also functioning as a switch de-bounce circuit. At approximately the same instant, the recoil of the firearm forces a normally-open said dynamic recoil sensing switch (2) to close momentarily, thus supplying a high pulse to the other input of said two input NAND gate (4), with said R/C circuit (3) maintaining this high for approximately 1/20th of a second and also functioning as a switch de-bounce circuit. Said two input NAND gate's (4) previously high output state now falls to a low logic state. This falling edge triggers said programmable down-counter (5A) to decrement by one. This information is then fed to said decoder/driver (7), which decodes and drives said output display (8), thus displaying the amount of rounds remaining in the firearm's magazine or cylinder. After the user expends the remaining rounds, said programmable down-counter (5A) is re-set to the number as set by said set switch (6A) by pressing said re-set switch (6), and the firearm is reloaded in a normal fashion.

FIG. 3 demonstrates one type of recoil sensing component that may be used with this circuit as a said dynamic recoil sensing switch (2). When the firearm is discharged, inertia forces said metal piston (14) to push against and overcome the pressure exerted by said return spring (15). Said metal piston (14) then comes into contact with said stator contact (12) for an instant, thus completing the circuit momentarily.

FIG. 4 and FIG. 5 demonstrate one type of acoustic switch that may be used as a said acoustic sensing switch (1). When there is an absence of noise impingement said thin metal contact (20) is kept out of contact with said metal stator contact (21) by the elasticity of said acoustic membrane (19). When heavy noise impingement is present, as in the discharge of a firearm, said acoustic membrane (19) flexes inward, driving said thin metal contact (20) in contact with said metal stator contact (21) for an instant, thus completing the circuit momentarily.

FIG. 6 demonstrates the circuit of FIG. 2 mounted in said hard plastic case (24) and attached to said after-market hand grips (23), which are attached to said Colt Model 1911 pistol (26). Said set switch (6A) would be pressed seven times to set said output display (8) to the numeral "7". Said Colt Model 1911 pistol (26) is then fired until said output display (8) counts down to the numeral "0". The user then presses said re-set switch (6), which would now force said output display (8) to display the numeral "7"once again. The user can then reload and continue the process over again.

SUMMARY, RAMIFICATIONS, AND SCOPE

Thus the reader will see that the invention is simple to use and install, low in cost to manufacture, and dependable.

Although the description above contains many specifications, these should not be construed as limiting the scope of the invention but merely providing illustrations of some of the preferred embodiments of the invention. For example, the digital circuits may be constructed of CMOS or TTL components; the NAND gate may be an AND gate; the display may be constructed with liquid crystal displays, light emitting diodes, or Nixie tubes; the counter may be a BCD counter, a binary counter, etc.

Thus the scope of the invention should be determined by the appended claims and their legal equivalents, rather than by the examples given.

I claim:

1. An ammunition counting device comprising an acoustic sensing transducer and a recoil sensing transducer electrically connected to the inputs of a logic gate, with the output of said logic gate connected to an electronic counting means, with the output of said electronic counting means connected to a display means, whereby the user is capable of quickly and reliably viewing the amount of rounds fired from any firearm.

* * * * *